US007527157B2

(12) United States Patent
Shinn et al.

(10) Patent No.: US 7,527,157 B2
(45) Date of Patent: May 5, 2009

(54) WHEEL BARROW RACK AND METHOD OF STORING A WHEEL BARROW

(75) Inventors: Kevin R. Shinn, Smithville, OH (US); Erik Eagleman, Nashville, IN (US); Michael Scherzer, Akron, OH (US); Michael A. Gregory, Cuyahoga Falls, OH (US)

(73) Assignee: Rubbermaid, Incorporated, Huntersville, NC (US)

( * ) Notice: Subject to any disclaimer, the term of this patent is extended or adjusted under 35 U.S.C. 154(b) by 347 days.

(21) Appl. No.: 11/121,568

(22) Filed: May 4, 2005
(Under 37 CFR 1.47)

(65) Prior Publication Data

US 2006/0017265 A1 Jan. 26, 2006

Related U.S. Application Data

(60) Provisional application No. 60/637,190, filed on Dec. 17, 2004, provisional application No. 60/567,930, filed on May 4, 2004.

(51) Int. Cl.
*A47F 5/00* (2006.01)

(52) U.S. Cl. ..... 211/89.01; 211/87.01; 211/96; 211/119

(58) Field of Classification Search ..... 211/70.6, 211/106, 113, 104, 18, 19, 20, 21, 23, 195, 211/88.04, 85.31, 85.15, 85, 118, 13.1, 85.29, 211/87.01, 89.01, 96, 119; 248/691, 205.1, 248/207; 280/653
See application file for complete search history.

(56) References Cited

U.S. PATENT DOCUMENTS

| | | | | | |
|---|---|---|---|---|---|
| 901,926 | A | * | 10/1908 | Watt | 248/235 |
| 2,389,910 | A | * | 11/1945 | Hoffman | 211/34 |
| 2,959,297 | A | * | 11/1960 | Larson | 108/29 |
| 4,106,736 | A | * | 8/1978 | Becker et al. | 248/222.51 |
| 4,136,782 | A | * | 1/1979 | Hugel | 211/19 |
| 4,467,925 | A | * | 8/1984 | Ratzloff et al. | 211/70.6 |
| 4,583,646 | A | * | 4/1986 | Bowman | 211/32 |
| 5,096,072 | A | * | 3/1992 | Link | 211/130.1 |
| 5,755,414 | A | * | 5/1998 | Remmers | 248/201 |
| 5,762,210 | A | * | 6/1998 | Dahill | 211/60.1 |
| 5,941,397 | A | * | 8/1999 | Buchanan et al. | 211/19 |
| 6,204,440 | B1 | * | 3/2001 | Yu | 84/327 |
| D447,848 | S | | 9/2001 | Laga et al. | |
| D450,904 | S | | 11/2001 | Laga et al. | |
| 6,766,997 | B2 | * | 7/2004 | Stewart, III | 248/690 |

* cited by examiner

*Primary Examiner*—Katherine W Mitchell
*Assistant Examiner*—Colleen M Quinn
(74) *Attorney, Agent, or Firm*—Dennis J. Williamson; Moore & VanAllen, PLLC

(57) ABSTRACT

A wheel barrow storage rack has an elongate vertically oriented body with a top end mounted near to a wall. A wheel barrow support is carried at a bottom end of the body. An adjustable bracket assembly is vertically positionally adjustable along the body. A wheel barrow catch is pivotally carried by the adjustable bracket assembly.

20 Claims, 7 Drawing Sheets

30
64
66
50
20
56b
56a
32
24
22
36
37
34
28
40
38
70
58
26

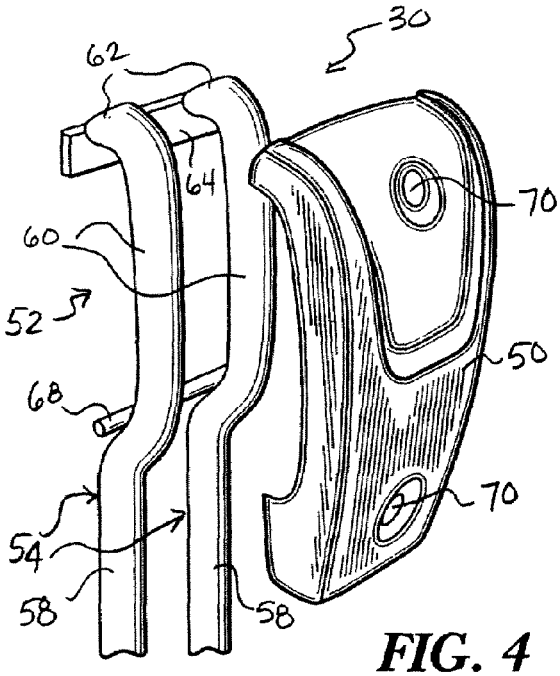
FIG. 4
FIG. 5
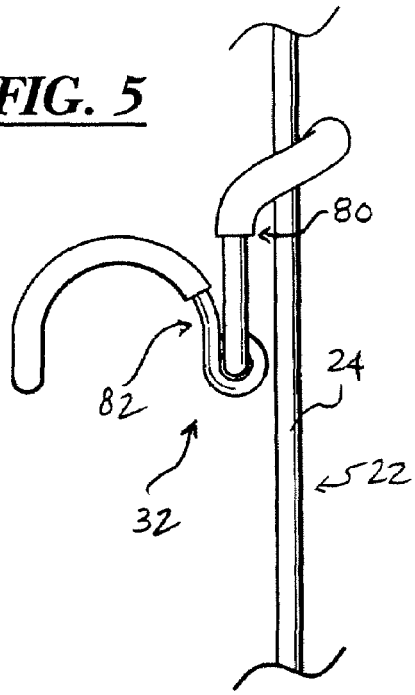
FIG. 6
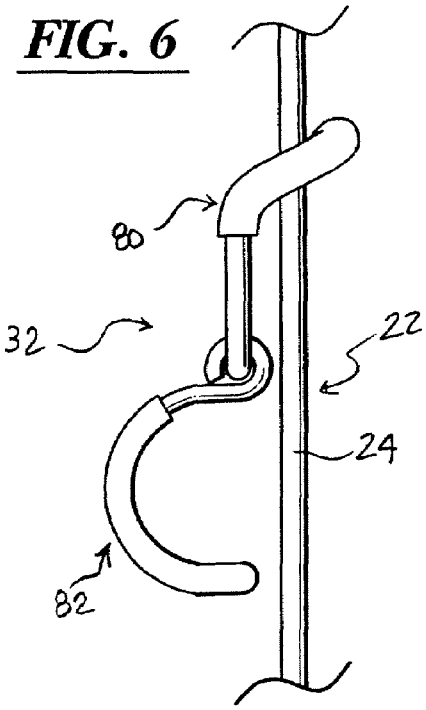
FIG. 7
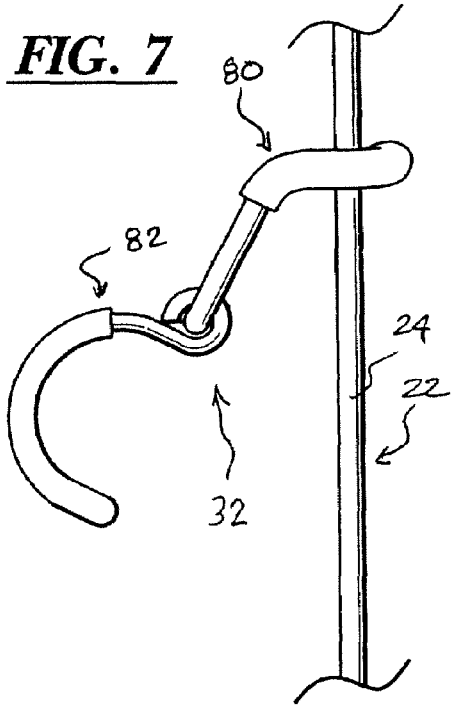

WHEEL BARROW RACK AND METHOD OF STORING A WHEEL BARROW

RELATED APPLICATION DATA

This patent is related to and claims the priority benefit of U.S. Provisional Application Ser. No. 60/637,190, which was filed on Dec. 17, 2004, and U.S. Provisional Application Ser. No. 60/567,930, which was filed on May 4, 2004.

BACKGROUND OF INVENTION

1. Field of the Disclosure

The present disclosure is generally directed to wheel barrows, and more particularly to a storage rack and method for storing a wheel barrow.

2. Description of Related Art

Wheel barrows are known to be relatively large, cumbersome, and typically heavy objects, often being made of heavy duty steel and/or wood. Storage of wheel barrows can sometimes create problems for consumers because of their overall size, weight, and odd shape. Consumers often just tip a wheel barrow up on its front end and rest it against a wall with the bucket opening facing the wall. The wheel barrow can very easily and inadvertently tip back over away from the wall. Such an occurrence can cause injury to persons standing nearby or damage to cars or other objects located in close proximity to the wheel barrow. Wheel barrows also take up a relatively large amount of storage space and stick out quite far from the wall and, thus, can be easily and unintentionally bumped when stored.

Attempts have been made to provide storage solutions and devices for storing wheel barrows. A typical storage hanger or rack can be of a two-piece construction that mounts directly to a wall. Such products are usually fixed in place on the wall and, once installed, are not adjustable to accommodate different sized wheel barrows. To adjust the hanger for accommodating a different sized wheel barrow, the known hangers must be uninstalled, readjusted, and reinstalled on the wall surface.

Further, the consumer is often required to lift the wheel barrow off the ground in order to place it in one of these storage racks. This can be difficult for the ordinary user because of the generally heavy, cumbersome, and odd-shape of the wheel barrow.

BRIEF DESCRIPTION OF THE DRAWINGS

Objects, features, and advantages of the present invention will become apparent upon reading the following description in conjunction with the drawing figures, in which:

FIG. 4 shows an enlarged exploded view of a top portion of the wheel barrow storage rack of FIG. 1.

FIG. 5 shows the adjustable bracket assembly in a locked position, but with a wheel barrow catch bracket in a raised position.

FIG. 6 shows an enlarged view of the adjustable bracket assembly of the wheel barrow storage rack of FIG. 3 and in a locked and stored position.

FIG. 7 shows the adjustable bracket assembly of FIG. 6 in an unlocked and movable position.

DETAILED DESCRIPTION OF THE DISCLOSURE

A wheel barrow a storage rack and method for storing wheel barrows are disclosed herein. The disclosed rack and method help to solve at least two problems with prior known racks and methods. First, the user need not fully lift the wheel barrow in order to store it in the disclosed rack. Second, the disclosed rack is very easily adjustable to accommodate different size or length wheel barrows without having to remove and reinstall the rack.

The disclosed rack and method utilize an adjustable bracket assembly to accommodate different sized and shaped wheel barrows. The disclosed rack can be directly mounted to a surface or wall. The disclosed rack can be secured in place using screws, can be suspended from a rail without the need to use hardware for installation, or can be mounted using both techniques.

The terms upper or top, lower or bottom, forward or front, and rear or back are used herein in relation to the installed or mounted condition of the rack. These terms are used as reference in order to provide positional and spatial relationships, where beneficial, for ease of description and understanding of the invention.

Figures 1, 2, 3:
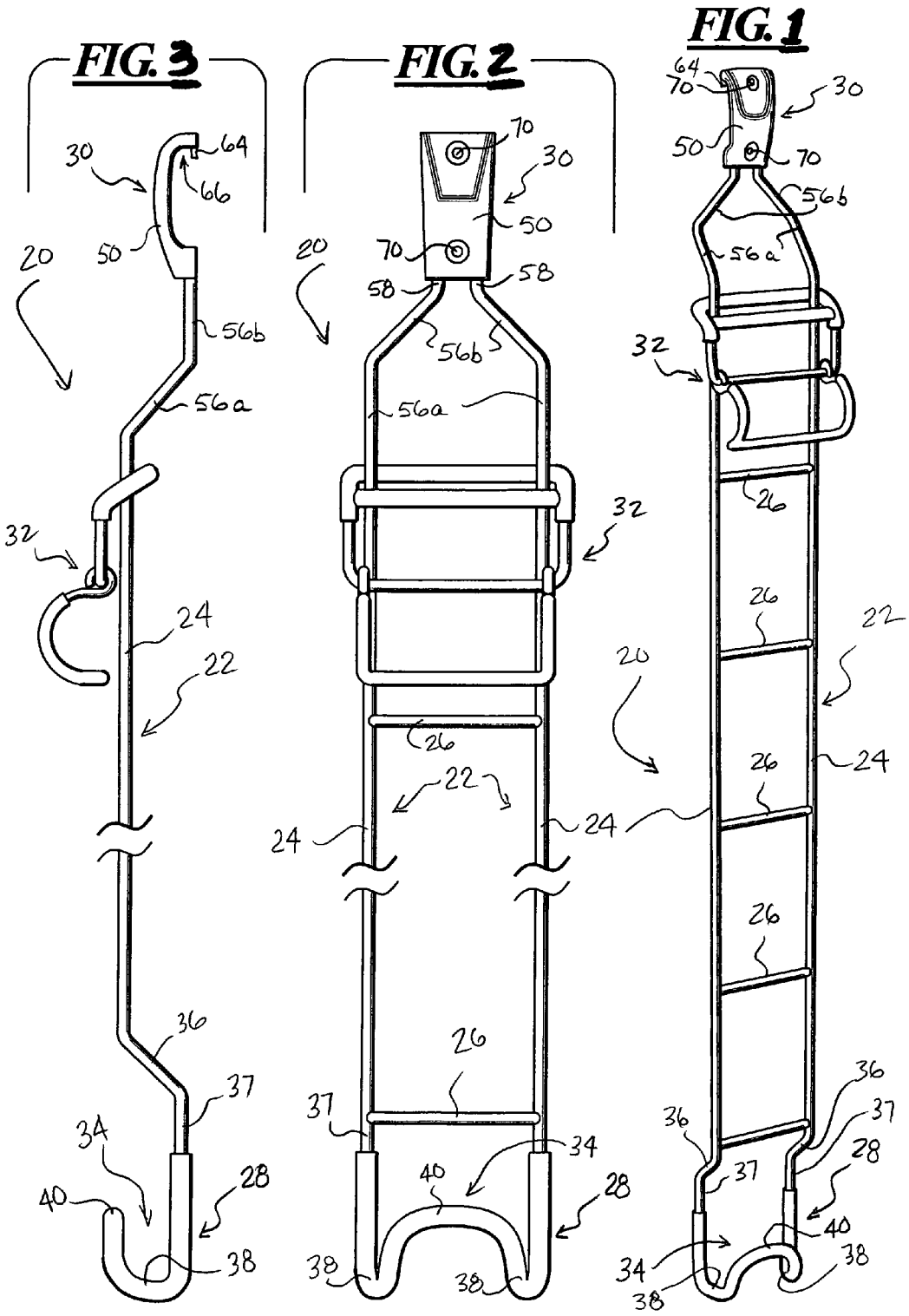
FIG. 1 shows a perspective view of one example of a wheel barrow storage rack constructed in accordance with the teachings of the present invention.
FIG. 2 shows a front view of the wheel barrow storage rack of FIG. 1.
FIG. 3 shows a side view of the wheel barrow storage rack of FIG. 1.

Turning now to the drawings, one example of a wheel barrow storage rack 20 is shown in FIGS. 1-3. The rack 20 has a vertical oriented body 22, which in this example is a wire-formed structure. The body 22 has a pair of elongate vertically extending side sections 24 and a plurality of horizontally oriented cross-bars 26 spaced apart vertically along the body and extending transversely or generally perpendicular to the side sections 24. The cross-bars interconnect the side sections for structural rigidity. In this example, the cross-bars 26 can be discrete wires or structures welded to and between the side sections 24. The storage rack 20 in this example has a wheel barrow support 28 carried at a bottom end of the rack and a rack mounting structure 30 at a top end of the rack. The rack 20 also includes an adjustable bracket assembly 32 that is selectively moveable along at least a part of the vertical length of the storage rack, as is described below.

In this example, the side sections 24 of the body 22 are formed from one continuous wire that extends downward from one side section, continues into the integral wheel barrow support 28, and then extends upward into the other side section. As shown in FIGS. 1-3, the wheel barrow support 28 in this example is an up-turned hook structure defining a wheel barrow receiving area 34. Each of the side sections 24 has a bent or angled rearward step 36 nearer the bottom end, and continues to a downwardly extending guide section 37 in each of the side sections. The guide sections 37 below the step 36 continue into an upwardly curved or upward facing concave curved section 38. A cross-leg 40 extends between the pair of curve sections 38 and is upwardly curved and, thus, downwardly concave in this example, as best shown in FIGS. 1 and 2. The receiving area 34 is defined between the guide sections 37 below the steps 36, the curved sections 38, and rearward of the cross-leg 40.

As will be evident to those having ordinary skill in art, the particular configuration and structure of the vertical body 22 and the wheel barrow support 28 can vary and yet fall within the spirit and scope of the invention. In different wire form examples, the wires can be bent in alternative manners and yet perform the requisite function of supporting a wheel barrow. Alternative materials such as plastic, can be used to form the body 22, as desired. The body can be a flat panel with reinforcing ribs, be a plastic grid formation, or the like.

The body 22 disclosed in this example is an elongate, rigid, one-piece structure. In an alternative embodiment, the body can be formed from two or more pieces linked together with successively lower pieces suspended from or connected to adjacent upper pieces so that the body 22 can be folded or disassembled to a compact storage and/or shipping configuration. One such example is disclosed in a second embodiment of the invention described below. Further, the size of the rack 20 and, particularly, the body 22 can vary considerably and yet fall within the spirit and scope of the invention. In one example, the body can extend to a full length of about 48 inches and will be suitable to support a vast range of wheel barrow sizes. However, the body can vary in length and/or width and yet fall within the spirit and scope of the invention.

The mounting structure 30 in this example is a dual function arrangement. As illustrated in FIGS. 1-3, and in greater detail in FIG. 4, the mounting structure 30 includes a plastic cap or cover 50 that is snapped onto the top end 52 of the body 22. In this example, the top end 52 is formed by the free ends 54 of the side section wires 24 creating the body 22. As shown in FIGS. 1-3, the side sections 24 include rearwardly and inwardly bent sections 56*a*, and 56*b*, respectively, angled toward one another and terminating at short, upward extending parallel intermediate wire sections 58. In side view, a somewhat tall, shallow C-shaped curved end 60 continues from each of the intermediate sections 58 and terminate at a rearwardly bent end 62. The C-shaped portions 60 are rearwardly open or concave. A generally flat cross-piece 64 is welded to each of these ends 62 spaced rearward of the wire of the C-shaped portions 60. The cross-piece 64 has a downward dimension sufficient to create a hook or capture region 66 between of the cross-piece 64 and the C-shaped portion 60. A small cross-bar 68 is also provided extending between and welded near each of the and near a rearward extending, lower end of the C-shaped portions 60. The cross-bar simply adds structural rigidity.

As will be evident to those having ordinary skill in the art, the configuration and structure of the top end 52 and mounting structure 30 can vary considerably and yet fall within the spirit and scope of the present invention. In another example, the ends 62 can be bent rearward and then downward to create the hook, eliminating the need for the welded cross-piece 64 in this example, and yet perform the same function. The cap or cover 50 can be configured to snap onto the top end 52 of the body 22. The cap 50 in this example has a pair of fastener receiving openings 70. Fasteners can be passed through these openings to secure the rack 20 to a surface, such as a wall. The hook or capture region 66 of the top end 52 can be utilized to hang the rack 20 from a rail or other structure carried on the wall. The fastener openings 70 of the cap can be used with screws, nails, or the like to secure the rack 20 to a wall, if desired. Alternatively, one can both hook and fasten the rack 20 to a surface, if desired.

Figure 8:
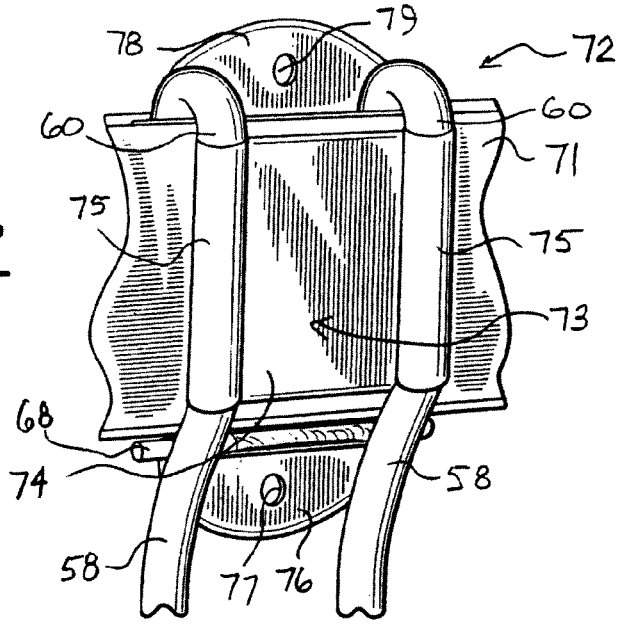
FIG. 8 shows an enlarged perspective view of an alternative embodiment of a top end of the wheel barrow storage rack of FIG. 1.

FIG. 8 illustrates an alternative example of a rack mounting structure 72. In this example, the rack is suspended from a rail 71. The C-shaped portions 60 include ends 62 that are turned down in this example, eliminating the cross-piece 64. The cross-bar 68 remains and again is welded spanning between the two intermediate wire sections 58. A decorative piece 73 is attached to the C-shaped portions 60 and has a center section 74 integrally connected to flanking connectors 75 that are either molded or snapped onto the C-shaped portions 60. The center section 74 can add additional rigidity to the mounting structure. A first attachment plate 76 is bent around or otherwise attached to the cross-bar 68 and has a first fastener opening 77 therein. A second attachment plate 78 is attached to the down-turned ends 62 of the C-shaped portions 60 and also has a fastener opening 79 therein. The mounting plates in this example are generally flat and can bear against a wall surface on opposite sides of the rail 71. Thus, the two plates can sit flush against the wall and fasteners can be driven through the two fastener openings 77 and 79 to secure the rack 20 against a mounting surface.

FIGS. 5-7 illustrate the general structure and movement of the adjustable bracket assembly 32. As shown in FIG. 6, the adjustable bracket assembly or bail assembly 32 has an adjustable section 80 and a wheel barrow catch section 82 pivotally carried by the adjustable section. In FIG. 6, the adjustable section 80 is in a locked position on the body 22 and the catch section 82 is in a dropped or stored position. In FIG. 7, the adjustable section is shown in an unlocked position permitting vertical sliding movement of the assembly 32 relative to the body 22. In FIG. 5, the adjustable section 80 is shown in the locked position and the catch section 82 is shown in a raised or released position pivoted upward relative to the locked adjustable section. The function and purpose of these movements are discussed in greater detail below when describing the function of the rack 20.

Figure 9A:
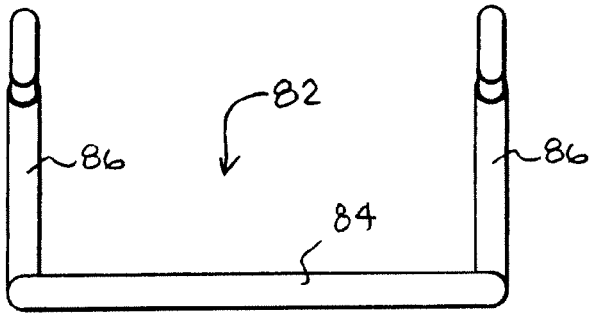
FIGS. 9A and 9B show a front and a side view, respectively, of the wheel barrow catch section of the adjustable bracket assembly of FIG. 6.
Figure 9B:
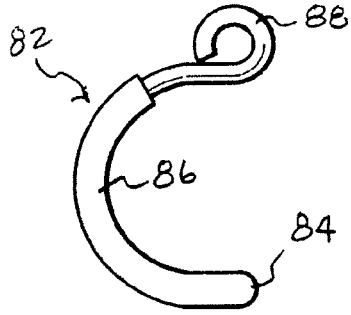

FIGS. 9A and 9B illustrate the structure of the disclosed catch section 82. In this example, the catch section 82 has a transverse catch bar 84 extending laterally between a pair of C-shaped connector arms 86. A plane of the connector arms 86 is oriented in this example generally perpendicular to the catch bar 84. The catch bar 84 and connector arms 86 are fabricated as a unitary or integral wire-formed structure. Thus, one end of each of the C-shaped connector arms 86 continues into the ends of the catch bar 84 to form the catch bar. The opposite free ends of the connector arms 86 are bent to form a connection loop 88 that captures a portion of the adjustable section 80 as illustrated in FIGS. 5-7 in this example. Thus, loops 88 can freely pivot relative to the adjustable section 80 so that the catch section 82 can be pivoted relative to the adjustable section.

Figure 10A:
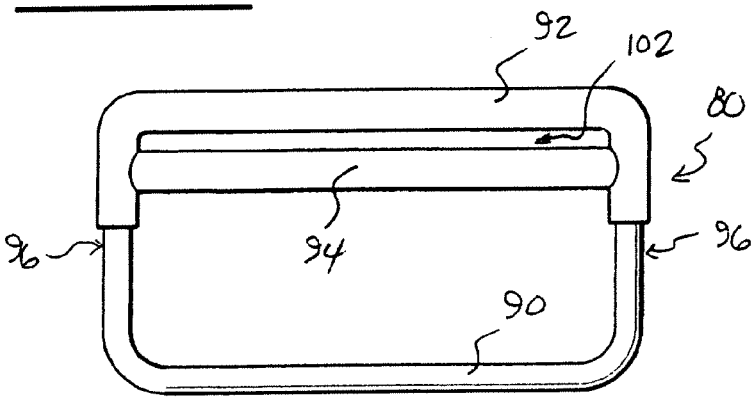
FIGS. 10A and 10B show a front and a side view, respectively, of the adjustable section of the adjustable bracket assembly of FIG. 6.
Figure 10B:
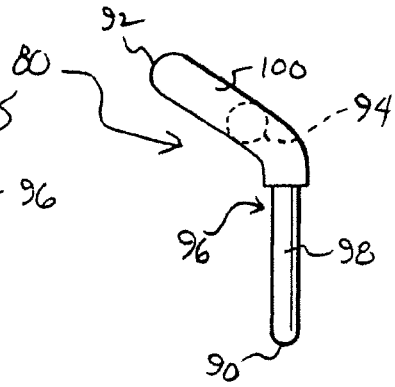

FIGS. 10A and 10B illustrate the structure of the disclosed adjustable section 80 of the adjustable bracket assembly 32 in this example. The adjustable section 80 has a lower cross-member 90, an upper cross-member 92, and an intermediate cross-member 94 extending laterally between a pair of side bars 96 and generally parallel to one another. In this example, the side bars 96 lie in essentially parallel spaced apart and vertically oriented planes and are bent rearwardly within those planes to form a lower side bar portion 98 and an upper side bar portion 100. The lower cross-member 90 extends integrally and laterally between and is formed as a continuation of the lower ends of the lower side bar portions 98. Similarly, the upper cross-member 92 extends integrally and laterally between and is a continuation of the upper ends of the upper side bar portions 100. In this example, the intermediate cross-member 94 extends between the upper side bar portions 100 spaced from the upper cross-member 92. A body receiving gap 102 is defined between the upper and intermediate cross-members 92 and 94, respectively. In this example, the body receiving gap 102 is sized such that the depth of the body 22 fits within the gap with some clearance when a plane defined by both the upper and intermediate cross-members and the upper side bar portions lies generally, or at least more nearly perpendicular, to the orientation of the body as shown in FIG. 7. If the adjustable section 80 is rotated to the locked position as shown in FIGS. 5 and 6, the upper cross-member 92 and intermediate cross-member 94 each move toward the side sections 24 of the body 22, effectively closing the gap 102. Friction acts to hold the adjustable section 80, and thus the bracket assembly 32 in place.

As shown in FIG. 10B, a plane defined by the lower side bar portions 98 and the lower cross-member 90 is at an angle relative to the plane defined by the upper side bar portions 100 and the upper and intermediate cross-members 92 and 94. The loops 88 of the catch section are formed around and loosely capture the lower cross-member 90 so that the catch section 82 is carried by the lower cross-member. As shown in FIG. 6, the weight of the catch section 82, when allowed to freely hang from the lower cross-member 90, rotates the adjustable section 80 to the locked position. As shown in FIGS. 10A and 10B, the upper part of the adjustable section 80, including the upper and intermediate cross-members 92 and 94, is dipped-coated with a friction enhancing material such as neoprene, some other rubber or a low durometer or surface tacky material. The coating will greatly enhance the friction between the cross-members and the body 22 when the bracket assembly 32 is in the locked position.

As shown in FIGS. 9A and 9B, as well as FIGS. 1-3, both the wheel barrow support 28 and at least the catch bar portion 84 of the catch section 82 can also be dipped-coated or otherwise covered with a friction-enhancing material. The material can assist in retaining a wheel barrow in a stored position on the rack 20 as discussed below, as well as act as a scratch-resistant or protective barrier between the material of the rack 20, which in this example is metal, and portions of a wheel barrow that contacts these components.

Figure 12:
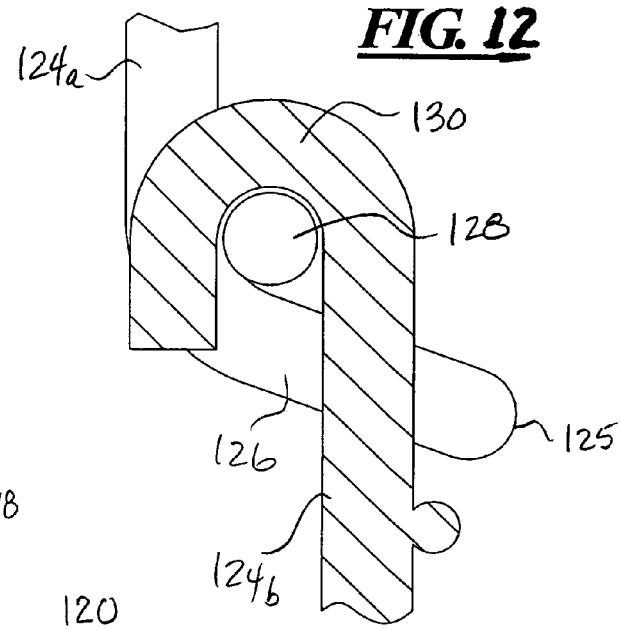
FIG. 12 shows a cross-section taken along line XII-XII of the wheel barrow storage rack in FIG. 11 and illustrating a joint between an upper and lower body section of the wheel barrow storage rack.
Figure 11:
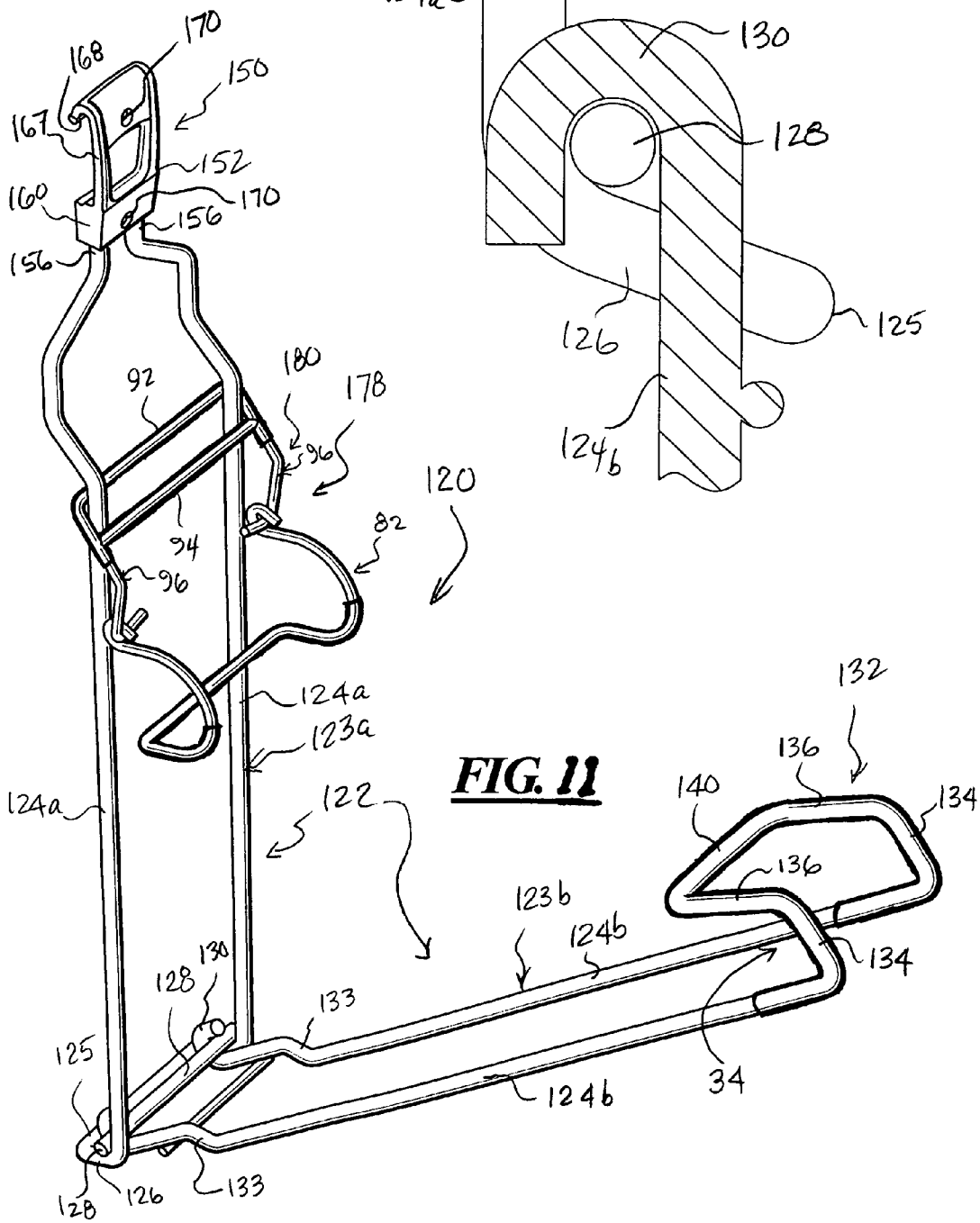
FIG. 11 shows a perspective view of another example of a wheel barrow storage rack constructed in accordance with the teachings of the present invention, and in a partially folded-up condition.
Figure 13:
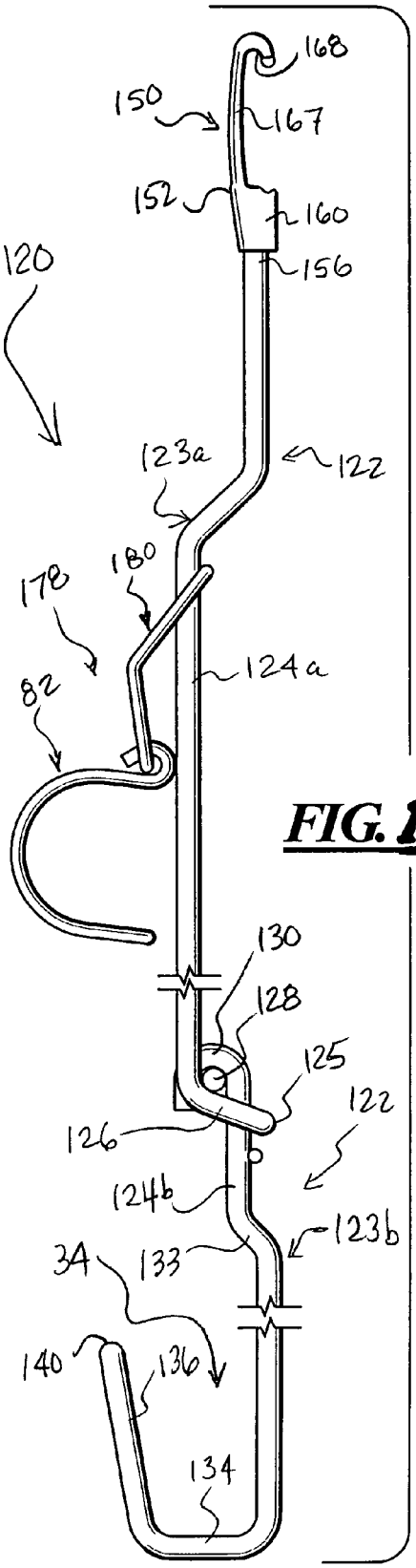
FIG. 13 shows a side view of the wheel barrow storage rack of FIG. 11 and in an extended or in-use configuration.

FIGS. 11-15B illustrate alternative configurations for several components of a wheel barrow storage rack in the form of a second embodiment of such a storage rack 120. In this example, the rack 120 includes a catch section 82 of an alternative adjustable bracket assembly. The catch section 82 is identical to the catch section discussed above in the prior example. FIGS. 11-13 show the rack 120 in this example as having a rack body 122 with an upper body section 123*a* and a lower body section 123*b*. The body sections 123*a* and 123*b* are pivotally connected to one another so that the rack 120 can be folded or collapsed to a storage or shipping configuration and can be disassembled. Again, the body 122 is formed of bent wire.

In this example, the upper body section 123*a* has a pair of spaced apart and vertically oriented side sections 124*a* with lower ends that continue into an integral and transversely oriented cross-member 125. The cross-member 125 is stepped rearward of the body sections 123*a* by a pair of rearwardly bent steps 126. A support bar 128 is received on, and in this example welded to, a top surface of the steps 126 and oriented generally parallel to the cross-member 125. A gap is provided between the cross-member 125 and support bar 128. The steps 126 are at an angle greater than 90° relative to the side section wires 124*a*. Thus, the support bar 128 is slightly elevated relative to the cross-member 125.

The lower body section 123*b* includes side sections 124*b* that are also generally vertically oriented. The top ends of the side sections 124*b* terminate at downwardly facing, concave curved hooks 130 that curve forward relative to the orientation of the rack 120. The hooks 130 in this example are received on the support bar 128 as shown in FIGS. 11-13 to pivotally suspend the lower body section 123*b* from the upper body section 123*a*.

The side sections 124*b* of the lower body section 123*b* also continue integrally downward to form a wheel barrow support 132. The wheel barrow support in this example is similar in construction to the wheel barrow support 28 in the prior example. However, in this example, a rearward step 133 in the side sections 124*b* is positioned nearer the upper ends and the downward facing hooks 130. Thus, a substantial portion below the steps 133 of the side sections 124*b* is stepped rearward of the portion above the steps. However, in each rack example, the steps 133 position the support member rearward slightly relative to a plane of the body of the respective rack. Also, the wheel barrow support 132 in this example is formed of forward extending legs 134 from the side sections 124*b* that then bend upward into upward extending legs 136. A cross-leg 140 extends between and integrally connects the upper free ends of the upward extending legs 136. In this example, the cross-leg 140, the upward extending legs 136, and the forward extending legs 134 are each substantially more linear in comparison to the various corresponding segments of the wheel barrow support 28 described with respect to the prior example. Again, the structure and configuration of the wheel barrow support 132 can vary considerably and yet fall within the spirit and scope of the present invention and perform the intended function of supporting a portion of a wheel barrow.

Figure 14B:
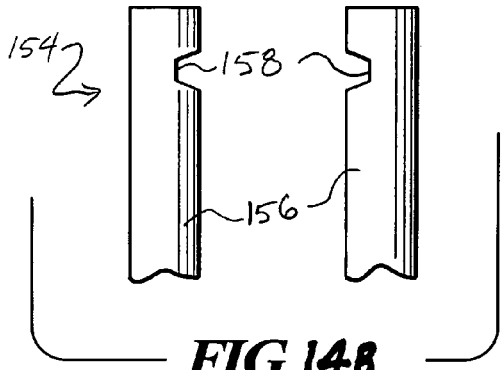
FIG. 14B shows a front view of the top end of the upper body section of the wheel barrow storage rack shown in FIG. 13 and with the mounting cap removed.
Figure 14A:
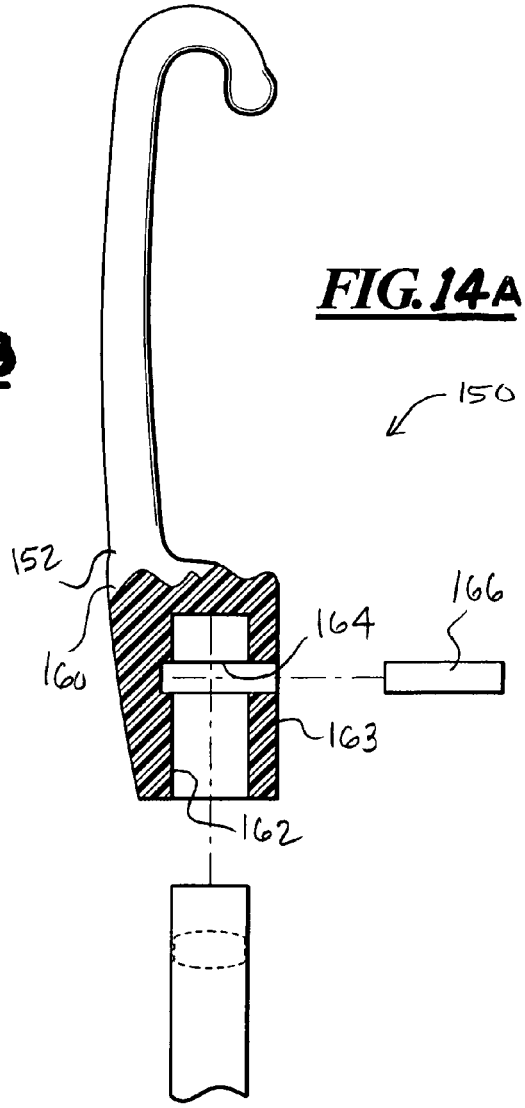
FIG. 14A shows an exploded, enlarged, and partial cross-section view of a top end of the wheel barrow storage rack of FIG. 13.
Figure 15A:
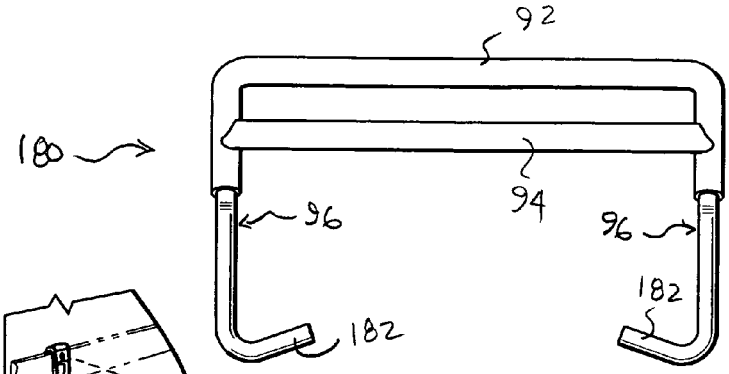
FIGS. 15A and 15B shows a front and a side view, respectively, of the adjustable section of the adjustable bracket assembly of FIG. 13.
Figure 15B:
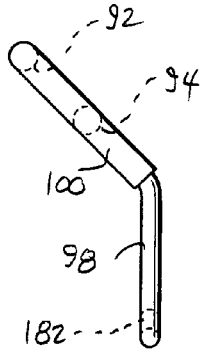

As shown in FIGS. 11, 13, 14A, and 14B, the rack 120 has an alternative mounting structure 150. The mounting structure 150 again in this example provides a dual attachment function. The mounting structure 150 permits hanging the rack 120 from a rail or other object on a surface and/or securely fastening the rack 120 to a mounting surface. In this example, the mounting structure 150 includes a cap or cover 152 secured to a top end 154 of the upper body section 123*a*. The top end 154 is formed by free upper ends 156 of the pair of upper body side sections 124*a*. Similar to the intermediate sections 58 in the prior example, the free ends 156 in this example generally extend vertically upward and are spaced slightly apart as shown in FIGS. 13 and 14B. Opposed interior surfaces of the wires of these free ends 156 include a pair of notches 158 extending in opposite directions into the wires and facing one another. As shown in FIG. 14A, the cap 152 includes a lower body part 160 with upwardly extending blind bores 162 for receiving the free ends 156 of the wires, and a middle side 163. A rear side 164 of the body part 160 includes a horizontal slot formed therein. The cap 152 can be slid downward onto the free ends 156 of the side sections 124*a*, with the free ends received in the bores 162. When the slot 164 is aligned with the notches 158, a substantially rigid or metal slug 166 can be slid into the slot 164 and notches to retain the cap 152 on the top end 154 of the upper body section 123*a*.

The cap 152 in this example also includes an elongate, shallow C-shaped part 167, when viewed from the side extending upward from the lower body part 160 to define a downwardly concave hook or capture region 168 region. The hook 168 can be hooked onto a rail or other object to suspend the rack 120 from a mounting surface. Again, the upper part 167 of the cap 152 in this example also has a pair of fastener openings 170 provided for receiving fasteners therethrough. Thus, the rack 120 can be suspended and/or securely fastened to a mounting surface as desired. In an organizer system, a rail can be provided for suspending any number of organizer components on a wall. The racks 20 and 120 are configured to be compatible with such an organizer system by simply hanging the racks from the rail provided as part of that system.

The rack 120 in this example has an adjustable bracket assembly 178 that includes the catch section 82 and an adjustable section 180 configured slightly different than the adjustable section 80 in the previous example. In this example, the adjustable section 180 has an intermediate cross-member 94, an upper cross-member 92, and a pair of side bars 96 constructed essentially identically to the prior example. The lower cross-member 90 of the prior example has been replaced by a pair of inward extending and slightly upwardly bent connector legs 184. As shown in FIG. 11, the loops 88 of the catch section 82 are received over the connector legs 182 pivotally connecting the catch section to the adjustable section 180 in this example.

Again, the wheel barrow support 132, portions of the catch section 82, and the full cross-member, upper part of the adjustable section 180 can be dip-coated, or otherwise covered to enhance durability, scratch-resistance, and friction enhancement. Also, as shown in FIG. 11, the two separate body sections 123*a* and 123*b* can pivot relative to one another and can be disassembled entirely. To disassemble the rack 120 of FIG. 11, one may simply further rotate the lower body section 123 upward until the hooks 130 release from the support bar 128. As shown in FIG. 13, in the in-use configuration, the back side of the side sections 124*b* of the lower body section 123*b* bear against the cross-member 125 because of the gap between the support bar 128 and cross-member 125 and because the higher elevation of the support member. Thus, the lower body section 123 will not loosely swing further rearward than the position shown.

Figure 16:
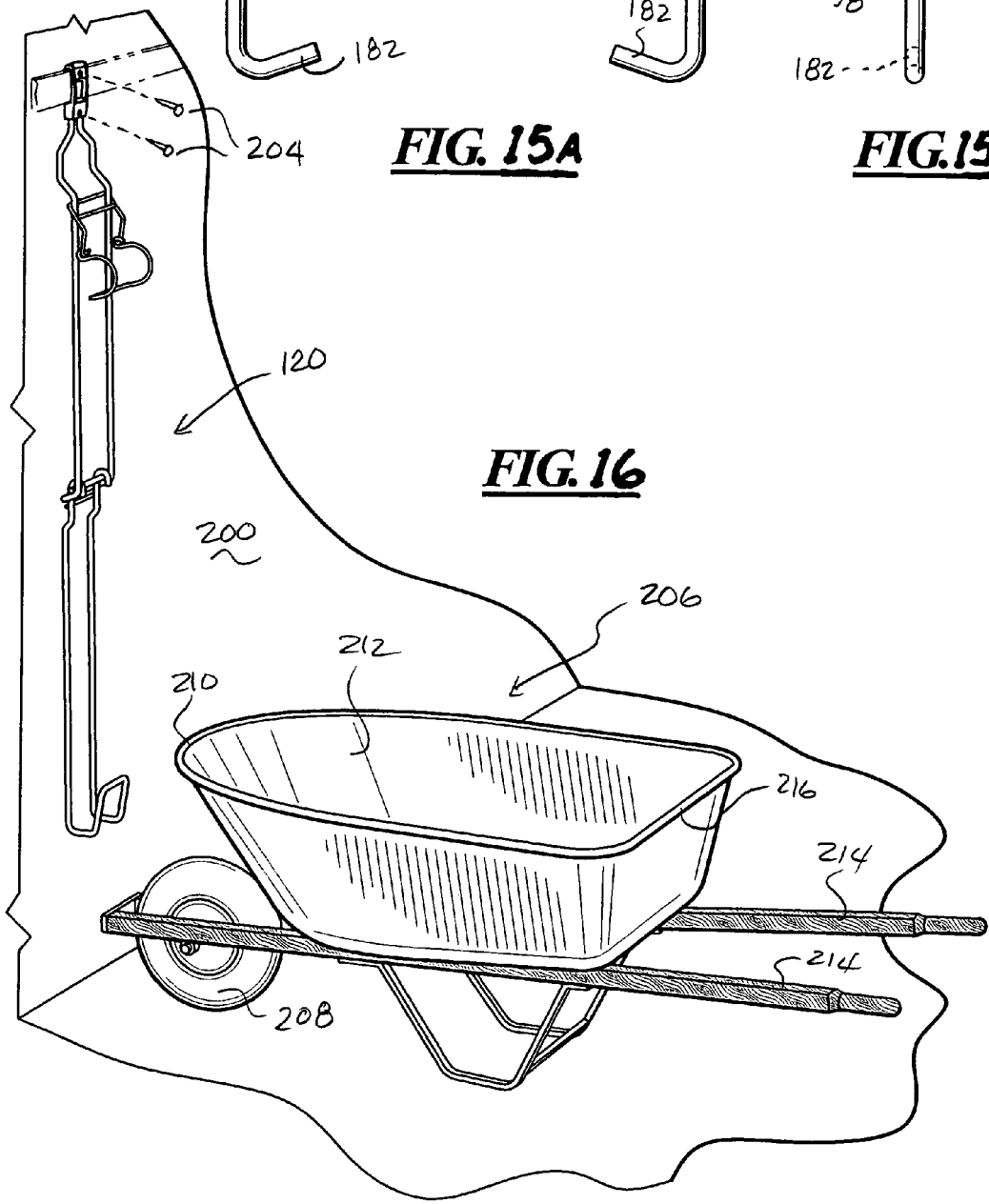
FIG. 16 shows the wheel barrow storage rack of FIG. 13 mounted and suspended from a wall with a wheel barrow poised for installation on the rack.
Figure 17:
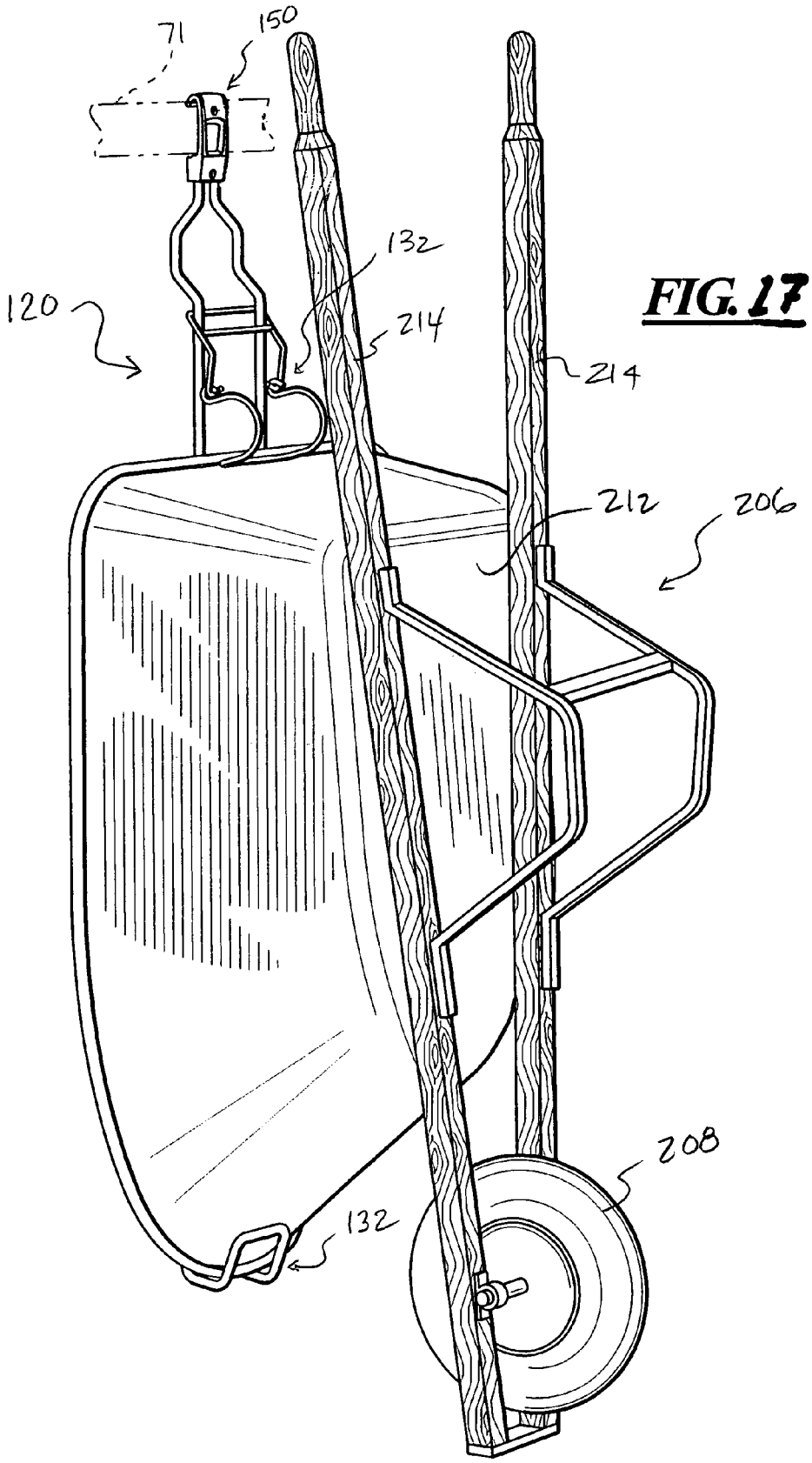
FIG. 17 shows the wheel barrow of FIG. 16 tipped up and stored on the wheel barrow storage rack.

FIGS. 16 and 17 illustrate an installed wheel barrow storage rack 120 and a method of storing a wheel barrow. A mounting rail 71 is depicted as being mounted to a vertical surface 200. The hook 166 of the mounting structure 150 of the rack 120 is shown hooked onto and suspended from the rail. Optional fasteners 204 can be received through the receiving openings 170 in the cap 152, if desired, as shown in FIG. 16. A user should mount the rack 120 at an elevation adequate to receive and store a wheel barrow that is simply rolled into position as described below. In the in-use configuration, the lower body section 123*b* is suspended by the hooks 130 from the upper body section 123*a*. The adjustable bracket assembly 178 is shown in nearly an uppermost position on the body 122.

A wheel barrow 206 can be positioned forward of the rack 120 with a wheel 208 and a front lip 210 of the wheel barrow bucket 212 positioned nearest the wheel barrow support 132. In order to store the wheel barrow 206, a user simply grasps the handles 214 of the wheel barrow 206 and raises the handles upward, which lowers the front lip 210 of the bucket 212 into the wheel barrow support 132. The guide parts of the side sections 124*b* guide the bucket into the receiving area and the cross-leg 140 retains the bucket in the receiving area of the wheel barrow support. The user then continues to raise the wheel barrow 206 by the handles 214 until a rear lip 216 of the bucket 210 is positioned adjacent the body 122 of the rack 120.

The adjustable bracket assembly 178 may have been previously positioned in a proper location along the body 122, or can be positioned easily in a proper location on the body 122 once the wheel barrow is raised into the stored configuration shown in FIG. 17. The adjustable bracket assembly 178 can be moved vertically along the body 122 to a desired position when oriented as shown in FIG. 7. Once in the proper position, the adjustable section 180 can be rotated or simply released, and it will drop to the locked position of FIGS. 5 and 6. The user can, as needed, raise the wheel barrow catch section 82 to the raised or released position as shown in FIG. 5 to position the rear lip 216 of the wheel barrow against the body 122 of the rack 120. The catch section 82 can then be lowered or dropped so that the catch bar 84 bears against the rear lip 216 of the wheel barrow 206. The weight of the wheel barrow may tip rearward, but the structure of the catch bar, connector arms, and adjustable section are such that the catch bar will very easily retain the wheel barrow in the upright, stored position as shown in FIG. 17.

In the disclosed examples, the adjustable sections 80 and 180 are shown with the portions (92 or 182) connected to the catch section 82 positioned on the forward side of the rack 120, i.e., on the same side that the wheel barrow is stored. In an alternative example, though not shown, the adjustable sections 80 and 180 could be reversed when installed on the body 122 so that the connecting portions (92 or 182) to the catch section are on the back side of the body. In such an orientation, the weight of the wheel barrow, if it is inclined to tip rearward, would increase the friction between the adjustable sections 80 or 180 and the body 22 or 122, and particularly between the upper and intermediate cross-members 90, 92 and the side sections of the body. Tests of prototypes have shown that the wheel barrow storage racks of FIGS. 20 and 120 work equally well, regardless of orientation of the adjustable section as disclosed herein but that it is easier to release the catch section in the orientation shown in the drawings. In this alternate configuration, the catch section 82 would be reversed when connected to the adjustable sections 80 or 180.

The disclosed racks and methods allow for easy, convenient wheel barrow storage for the user. The user simply rolls the wheel barrow up to the wall with the front lip of the wheel barrow rear the support. The user then need only lift the handles of the wheel barrow, raise it up vertically, and attach the catch section to the rear lip of the wheel barrow. If utilized with an elongate support rail system, the rack position can also be horizontally adjusted along the rail as desired by the user for versatile, easy, and convenient storage of a wheel barrow.

The disclosed racks can be made using a wide variety of materials and components. In one example, wire components of various gages, as desired, can be utilized. A cast aluminum rail gripper can be employed along with the skeleton to provide a strong structure to handle the load imposed on the rack. However, other materials can be employed alone or in combination, such as plastics, alternative resins, fiberglass, carbon fiber, wood, sheet metal, mesh, or the like.

The disclosed racks can be formed of welded, bolted, screwed and/or hinged components. The racks can also be provided in various sizes and forms to accommodate a wider variety of sized and shaped items to be stored. The disclosed racks potentially has relatively unlimited length or size capability. The disclosed racks can alternatively be constructed from hollow tubing and be capable of telescoping to different lengths and/or widths. The racks could be used to store other wheeled items as well as other garage tools and outdoor tools.

The disclosed racks may be only one-piece in assembled condition and can come from the manufacturer fully assembled. Alternatively, the racks can come in assembled or unassembled parts. In one example, the racks can be folded up when not in use to take up less space and to keep the lower portion of the rack out of reach of small children. The disclosed racks can be constructed having two or more pieces suspended together, or can be one piece without folding capability. Also, the adjustable assembly bracket may be formed as one piece where pivoting the catch section will also pivot the whole bracket to lock or unlock.

The racks can also adjust to accommodate various sized and shaped wheel barrows without being removed or uninstalled. The disclosed racks and methods prevent the need for lifting the entire weight of the wheel barrow for storage. Instead, the wheel barrow need only be rolled to position and tilted into place in the rack. This makes installation safer and easier for the user. However, the racks can be installed at higher positions that may require lifting a wheel barrow upward in order to store it on the rack.

Although certain wheel barrow storage racks and methods have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A wheel barrow storage rack comprising:

an elongate vertically oriented body having a top end and a bottom end, the top end mountable to a wall;

a wheel barrow support carried at the bottom end of the body;

an adjustable bracket assembly vertically slidable along the body; and a wheel barrow catch pivotally carried as part of the adjustable bracket assembly, wherein the wheel barrow catch is pivotable relative to the adjustable bracket assembly between a stored position and a raised position, the adjustable bracket being slidable along the body when in a released orientation and frictionally stationary on the body when in a locked orientation, wherein the adjustable bracket is a wire form part having a pair of elongate transverse cross-members and a pair of connecting bars with opposite ends connected to ends of the elongate cross-members, and having an intermediate cross-member spaced from an upper one of the elongate cross-members traversing between the connecting bar and defining a body receiving gap between the upper cross-member and the intermediate cross-member, wherein the body is captured within the body receiving gap.

2. A wheel barrow storage rack according to claim 1, wherein the wheel barrow catch includes a transverse catch bar and a pair of C-shaped connector bars extending from opposed ends of the capture bar, each of the C-shaped connector bars having free ends pivotally coupled to the other of the cross-member of the adjustable bracket.

3. A wheel barrow storage rack according to claim 1, further comprising a pair of connector legs, one each extending oppositely toward one another from a lower end of the adjustable bracket connecting bars, and wherein the wheel barrow catch includes a portion pivotally coupled to each of the connector legs.

4. A wheel barrow storage rack according to claim 3, wherein the wheel barrow catch further comprises a transverse catch bar and a pair of C-shaped connector bars each terminating at a free end coupled one each to one of the connector legs of the adjustable bracket.

5. A wheel barrow storage rack comprising:

an elongate vertically oriented body having a top end and a bottom end, the top end mountable to a wall;

a wheel barrow support carried at the bottom end of the body;

an adjustable bracket assembly vertically slidable along the outside of the body; and a wheel barrow catch pivotally carried as part of the adjustable bracket assembly, wherein the elongate vertically oriented body is a wire-formed configuration with an upper body section and a lower body section, the lower body section being generally U-shaped and including a pair of generally vertically oriented spaced apart side sections each terminating at a downward facing hook near their top ends and each integrally interconnected to one another at common bottom ends bent to form an up-turned hook defining the wheel barrow support, and the upper body section also having a U-shaped configuration including a pair of generally vertically oriented side sections integrally connected at common bottoms defining a transverse cross-member and having a support bar connected to and transversing between the side sections parallel to and spaced from the cross-member, and wherein the down-turned hooks of the lower body section are hooked onto the transverse wire of the upper body section such that the lower body section is pivotally suspended from the upper body section.

6. A wheel barrow storage rack comprising:

an elongate vertically oriented body having a top end and a bottom end, the top end mountable to a wall;

a wheel barrow support carried at the bottom end of the body;

an adjustable bracket assembly vertically slidable along the body; and a wheel barrow catch pivotally carried as part of the adjustable bracket assembly, wherein the adjustable bracket assembly has a pair of generally parallel, spaced apart cross-members defining a gap therebetween, wherein the body is captured with the gap between the pair of cross-members, and wherein the gap is sized to permit the adjustable bracket to slide vertically relative to the body when a plane through the cross-members is oriented substantially perpendicular to a plane of the body, and wherein the cross-members frictionally engage the body therebetween when the plane of the cross-members forms a downward facing acute angle relative to the plane of the body.

7. A wheel barrow storage rack comprising:

a body having a top end, a bottom end, and arranged to be mounted to a support wall in a generally vertical orientation;

a wheel barrow support formed adjacent the bottom end of the body, the wheel barrow support arranged to engage a first portion of a wheel barrow;

an adjustable bracket assembly, the adjustable bracket assembly having a pair of transverse cross-members arranged to directly engage and straddle the body, the adjustable bracket assembly securable to the body at a plurality of vertical locations;

the adjustable bracket assembly including a wheel barrow catch comprising a downward facing hook arranged to engage a second portion of a wheel barrow; and wherein the adjustable bracket assembly is shiftable between a released position in which the adjustable bracket assembly is slidable relative to the body between the plurality of vertical locations, and a locked position in which the adjustable bracket assembly is secured to the body in a selected one of the plurality of vertical locations; and wherein when the adjustable bracket assembly is in the locked position, the adjustable bracket assembly is maintained at the selected vertical location exclusively by friction between the cross-members and the body.

8. A wheel barrow storage rack according to claim 7, wherein the top end of the body comprises a hook for mounting the rack, the hook arranged to engage a horizontally-oriented rail.

9. A wheel barrow storage rack according to claim 7, wherein the body, the adjustable bracket assembly, and the wheel barrow catch are each formed of wire.

10. A wheel barrow storage rack according to claim 7, wherein the wheel barrow support is an up-turned hook configuration positioned at the bottom end of the body and defining a wheel barrow bucket receiving area.

11. A wheel barrow according to claim 7, wherein the wheel barrow catch is pivotable relative to the adjustable bracket assembly between a stored position and a raised position, the adjustable bracket being slidable along the body when in the released position and frictionally stationary on the body when in the locked position.

12. A wheel barrow storage rack according to claim 7, wherein portions of the adjustable bracket assembly and the wheel barrow catch are dip-coated in a resilient, friction enhancing material.

13. The wheel barrow storage rack of claim 7, wherein the body includes a pair of vertically oriented side sections, wherein each side section includes a free end, and each free end forms the top end of the body.

14. The wheel barrow storage rack of claim 7, wherein the body includes a pair of vertically oriented side sections, wherein each side section includes an inwardly bent section angled toward the other side section and terminating at short, upwardly extending parallel intermediate sections, wherein a C-shaped curved end continues from each of the intermediate sections and terminates at a rearwardly bent end, thereby forming the top end of the body.

15. The wheel barrow storage rack of claim 7, wherein the top end of the body is adapted to receive a cap, the cap arranged to secure the wheel barrow storage rack to a mounting surface.

16. The wheel barrow storage rack of claim 7, wherein the top portion of the body includes C-shaped portions having down-turned ends, a cross-bar attached between the C-shaped portions, a first attachment plate attached to the cross-bar, and a second attachment plate attached to the down-turned ends of the C-shaped portions, such that the first and second attachment plates are arranged to secure the wheel barrow storage rack to a mounting surface.

17. The wheel barrow storage rack of claim 11, wherein the wheel barrow catch further comprises connector arms, each of which includes a loop for capturing a portion of the adjustable bracket assembly, wherein each loop freely pivots relative to the adjustable section, thereby allowing the catch to be pivoted relative to the adjustable section.

18. The wheel barrow storage rack of claim 13, wherein each of the side sections further includes a downwardly extending guide section near the bottom end of the body, wherein each of the downwardly extending guide sections continues to an upwardly curved section, thereby forming the wheel barrow support.

19. The wheel barrow storage rack of claim 7, wherein the wheel barrow support and the body are formed from one continuous wire.

20. The wheel barrow storage rack of claim 7, wherein the wheel barrow support is a single-piece, up-turned hook.

* * * * *